US009991649B1

(12) United States Patent
Nguyen

(10) Patent No.: US 9,991,649 B1
(45) Date of Patent: Jun. 5, 2018

(54) CABLE IDENTIFICATION SYSTEM

(71) Applicant: Dell Products L.P., Round Rock, TX (US)

(72) Inventor: John Nam Nguyen, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days. days.

(21) Appl. No.: 15/462,508

(22) Filed: Mar. 17, 2017

(51) Int. Cl.
*G08B 5/00* (2006.01)
*H01R 13/70* (2006.01)
*H01R 13/717* (2006.01)

(52) U.S. Cl.
CPC ..... *H01R 13/70* (2013.01); *H01R 13/717* (2013.01)

(58) Field of Classification Search
CPC .. H01R 13/70; H01R 13/7175; H01R 13/717; G01R 31/023; G08B 5/22
USPC ..... 340/815.4, 815.45, 641, 691.6, 5.8, 6.1, 340/10.42, 13.2, 13.31
See application file for complete search history.

(56) References Cited

U.S. PATENT DOCUMENTS

| | | | | |
|---|---|---|---|---|
| 7,049,937 | B1 * | 5/2006 | Zweig | H01R 13/641 324/66 |
| 7,221,284 | B2 | 5/2007 | Scherer et al. | |
| 8,624,577 | B2 * | 1/2014 | Bradley, II | H04L 43/50 200/51.07 |
| 9,083,170 | B2 | 7/2015 | Cudak et al. | |
| 9,652,708 | B2 * | 5/2017 | Downie | G06K 19/07749 |
| 2008/0102689 | A1 * | 5/2008 | Dhir | H01R 13/7175 439/490 |
| 2017/0310060 | A1 * | 10/2017 | Cote | H01R 13/7175 |

OTHER PUBLICATIONS

Diode—Wilkipedia, "Diode," Wikipedia, the free encyclopedia, Mar. 3, 2017, pp. 1-21; htps://en.wikipedia.org/wiki/Diode.

* cited by examiner

*Primary Examiner* — Toan N Pham
(74) *Attorney, Agent, or Firm* — Haynes and Boone, LLP

(57) ABSTRACT

A cable identification system includes a cable. A first connector is located on the cable and includes a first light emitting device. A first loop circuit includes the first light emitting device and a first diode. The first loop circuit is connected to a first wire that extends through the cable. A second connector is located on the cable and includes a second identification actuator that is configured to decouple the first wire from ground such that first radio waves produced adjacent the first loop circuit will induce a first current flow in the first loop circuit that causes the first light emitting device to emit light.

20 Claims, 13 Drawing Sheets

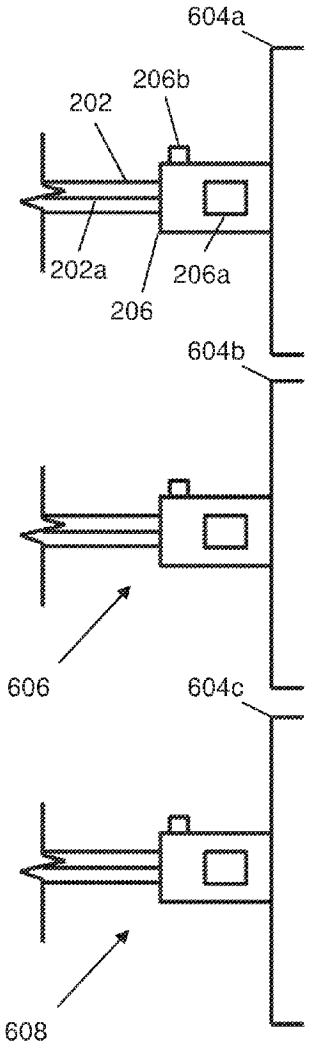
FIG. 8
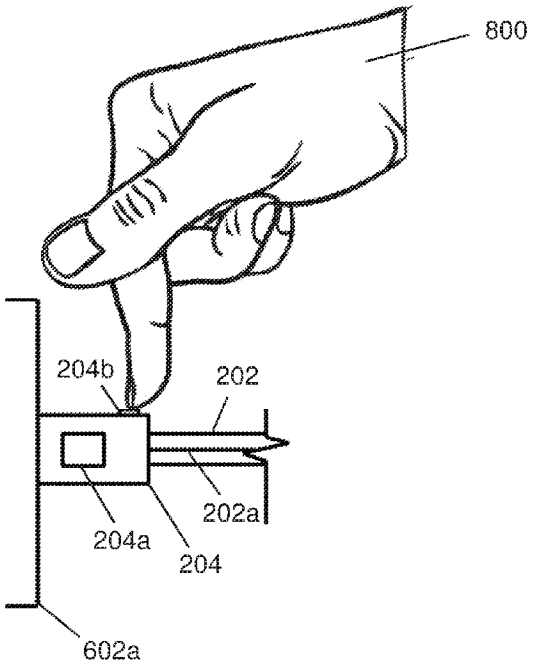

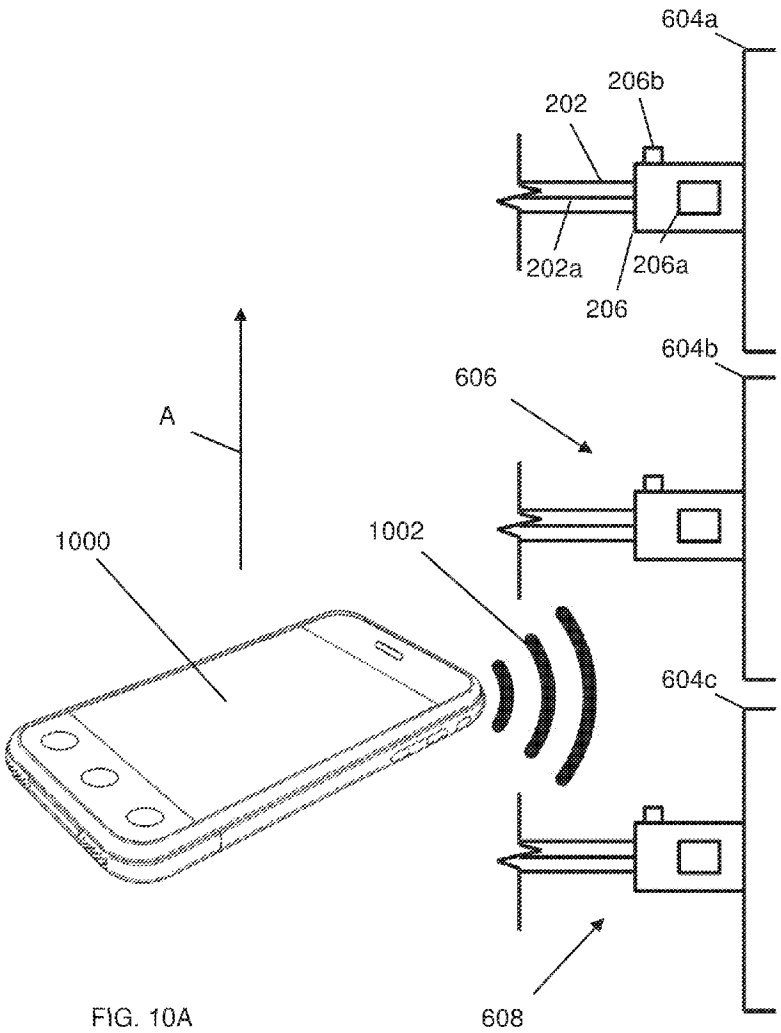
FIG. 10A
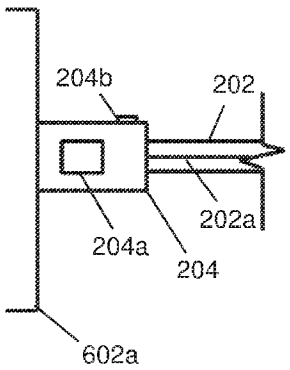

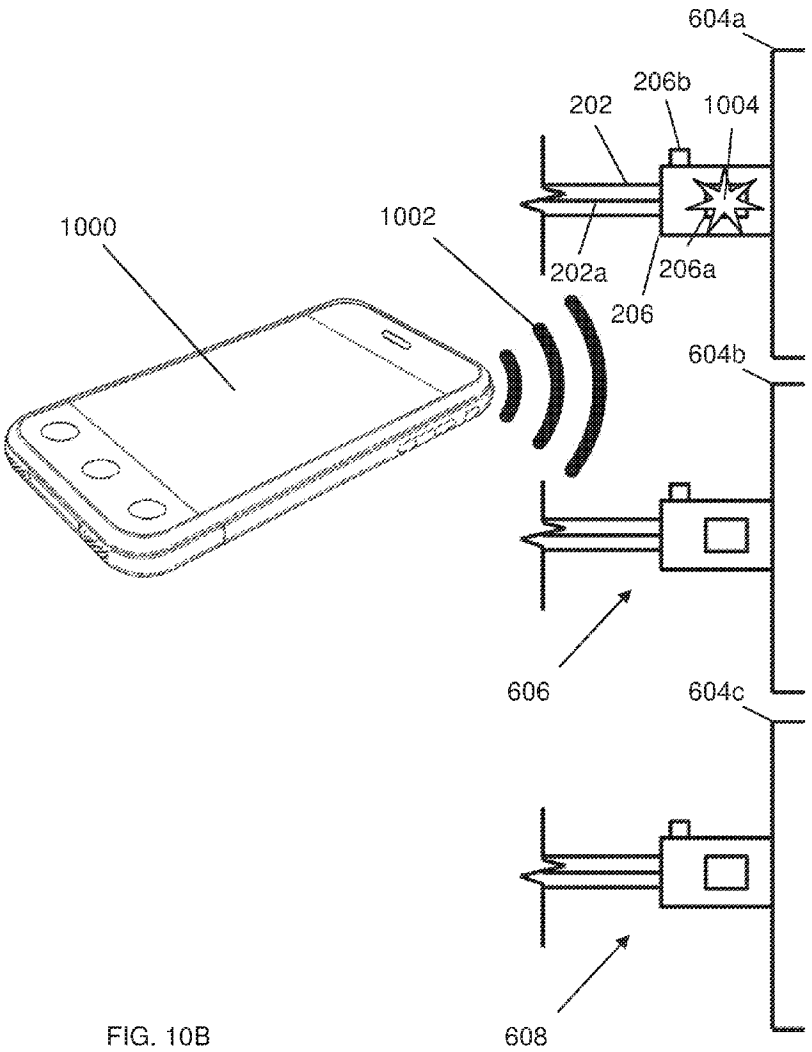
FIG. 10B
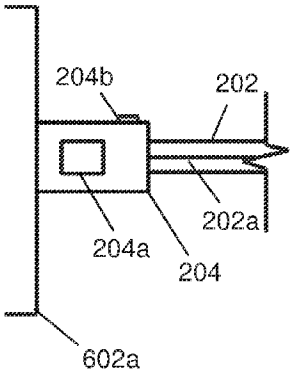

CABLE IDENTIFICATION SYSTEM

BACKGROUND

The present disclosure relates generally to information handling systems, and more particularly to the identification of cables and/or an information handling system to which they are connected.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems such as, for example, server devices, networking devices, and storage devices, are often coupled together via cables. For example, a networking cable such as, for example, an Ethernet cable, is often provided for each connection needed between such devices in a datacenter. As datacenters become larger and more connections are needed between its devices, the number of networking cables increases rapidly, which can raise some issues. For example, the tracing, tracking, and/or identification of networking cables and/or the device they connect in a large datacenter can be greatly complicated, particularly when relatively long networking cables are used, when networking cables are connected through patch panels between device racks, and when networking cables extend between device racks, rooms, or buildings. As such, the time necessary to replace a networking cable or otherwise address a networking cable issue can be extensive. Conventional solutions to this problem include the provisioning of LED or sound emitting indicators on the cable, and using power from a battery provided in the cable or from the device connected of the cable to activate the LED or sound emitting indicators. However, such solutions fail when that power source is lost due to, for example, a faulty device, faulty networking cable, dead battery, or other powering issue that prevents the powering of the LED or sound emitting indicator.

Accordingly, it would be desirable to provide an improved cable identification system.

SUMMARY

According to one embodiment, an Information Handling System (IHS) includes a first device; a second device; a cable extending between the first device and the second device; a first connector that is located on the cable and connected to the first device; a first light emitting device that is included on the first connector; a first loop circuit that includes the first light emitting device and a first diode, wherein the first loop circuit is connected to a first wire that extends through the cable; a second connector that is located on the cable and connected to the second device; and a second identification actuator that is located on the second connector and that is configured to decouple the first wire from ground such that first radio waves produced adjacent the first loop circuit will induce a first current flow in the first loop circuit that causes the first light emitting device to emit light.

BRIEF DESCRIPTION OF THE DRAWINGS

FIG. 8 is a side view illustrating an embodiment of a user providing for the identification of a cable and/or the device connected to that cable according to the method of FIG. 5.

FIG. 10A is a side view illustrating an embodiment of a user attempting to identify a cable and/or the device connected to that cable according to the method of FIG. 5.

FIG. 10B is a side view illustrating an embodiment of the identification of a cable and/or the device connected to that cable according to the method of FIG. 5.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
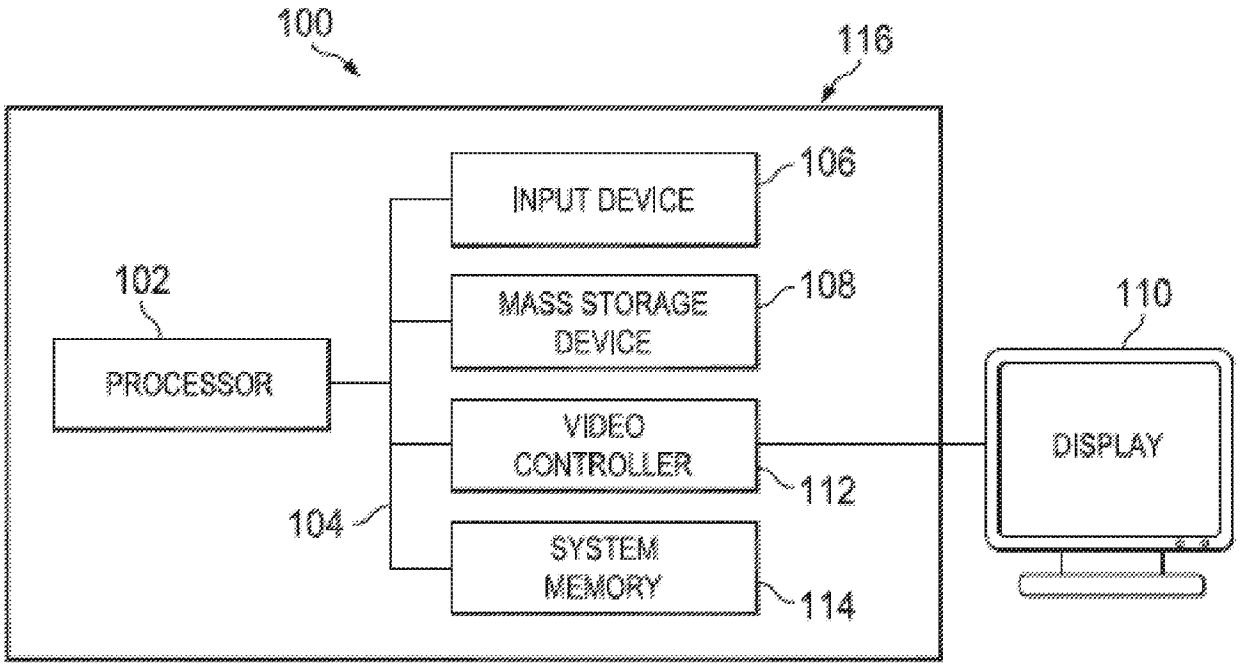
FIG. 1 is a schematic view illustrating an embodiment of an information handling system.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
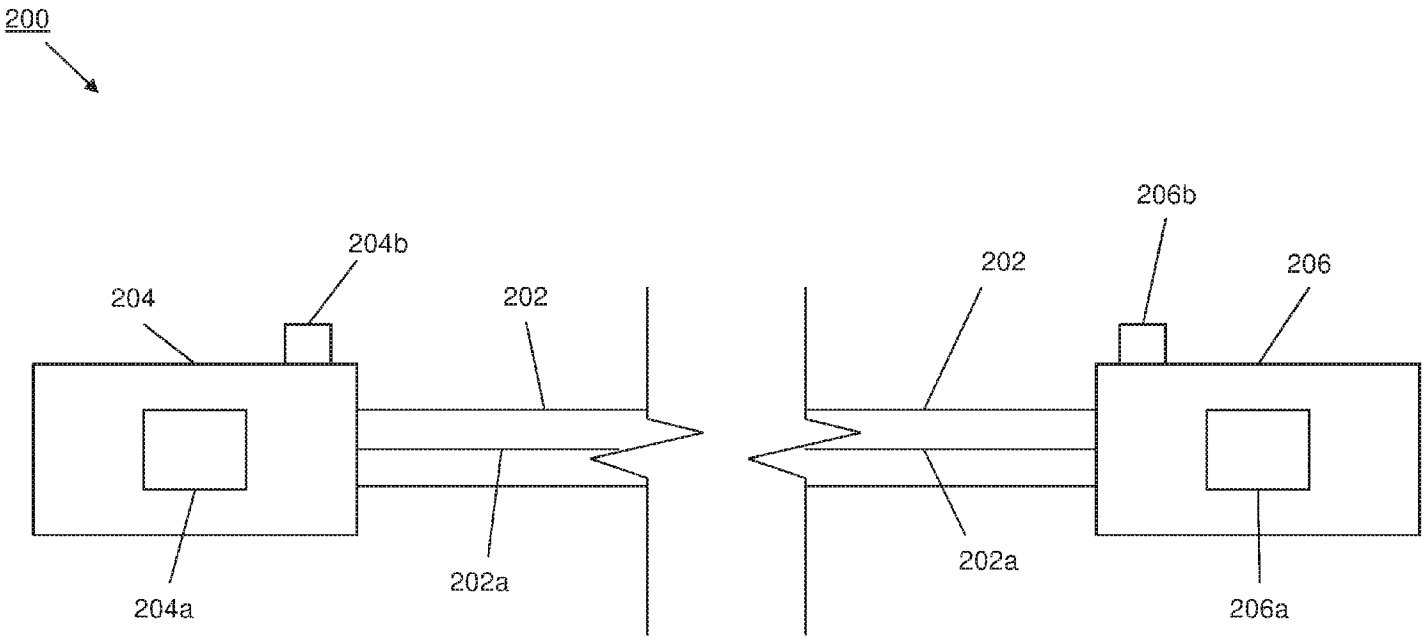
FIG. 2 is a schematic view illustrating an embodiment of a cable identification system.

Referring now to FIG. 2, an embodiment of a cable identification system 200 is illustrated that includes a cable 202 that extends between a first connector 204 and a second connector 206. In an embodiment, the cable 202 may be an Ethernet cable extending between Ethernet connectors that are provided for the first connector 204 and the second connector 206, although other types of cables (e.g., optical cables, Universal Serial Bus (USB) cables, and/or other cables known in the art) may benefit from the teachings of the present disclosure and thus are envisioned as falling within its scope. In a specific example, the cable may be a category 5 ("Cat 5") Ethernet cable with Ethernet connectors that are provided for the first connector 204 and the second connector 206, although other categories of Ethernet cabling will benefit from the teachings of the present disclosure and are envisioned as falling within its scope as well. The cable 202 includes an information transmission conduit 202*a* that extends through the cable 202 between the first connector 204 and the second connector 206, and in the discussions below may include at least one wire. For example, the information transmission conduit 202*a* may be provided by twisted pair wiring typically used in cat 5 Ethernet cabling, although as discussed above other types of information transmission conduits such as optical fibers and/or other information transmission mediums known in the art may fall within the scope of the present disclosure as well. While not illustrated in detail the cable 202 may include sheathes, shields, tape, insulation, and/or other cabling layers known in the art while remaining within the scope of the present disclosure.

In the illustrated embodiment, the first connector 204 includes a first light emitting device 204*a* that is located on a surface of the first connector 204. However, in other embodiments, the first light emitting device 204*a* may be located on the cable 202 while remaining within the scope of the present disclosure. Furthermore, in some embodiments, more than one light emitting device may be located on the first connector 204 and/or the cable 202 while remaining within the scope of the present disclosure. In the illustrated embodiment, the first connector 204 also includes a first identification actuator 204*b* that is located on a surface of the first connector 204. However, in other embodiments, the first identification actuator 204*b* may be located on the cable 202 while remaining within the scope of the present disclosure. In the illustrated embodiment, the second connector 206 includes a second light emitting device 206*a* that is located on a surface of the second connector 206 and that is coupled to the first identification actuator 204*b* as discussed in detail below. However, in other embodiments, the second light emitting device 206*a* may be located on the cable 202 while remaining within the scope of the present disclosure. Furthermore, in some embodiments, more than one light emitting device may be located on the second connector 206 and/or the cable 202 while remaining within the scope of the present disclosure. In the illustrated embodiment, the second connector 206 also includes a second identification actuator 206*b* that is located on a surface of the second connector 206 and that is coupled to the first light emitting device 204*a* as discussed in detail below. However, in other embodiments, the second identification actuator 206*b* may be located on the cable 202 while remaining within the scope of the present disclosure. In the discussions below, the first light emitting device 204*a* and the second light emitting device 206*a* are discussed as being provided by Light Emitting Diodes (LEDs). However, other light emitting devices that are configured to provide the functionality below may be substituted for the LEDs discussed below while remaining within the scope of the present disclosure. Furthermore, as discussed below, in some embodiments, identifiers and/or indicators that produce identifications/indications other than light (e.g., sound, movement, etc.) may be substituted for the light emitting devices when the current flow generation produced via the teachings of the present disclosure is sufficient to power those identifiers and/or indicators and produce their identifications/indications.

Figure 3:
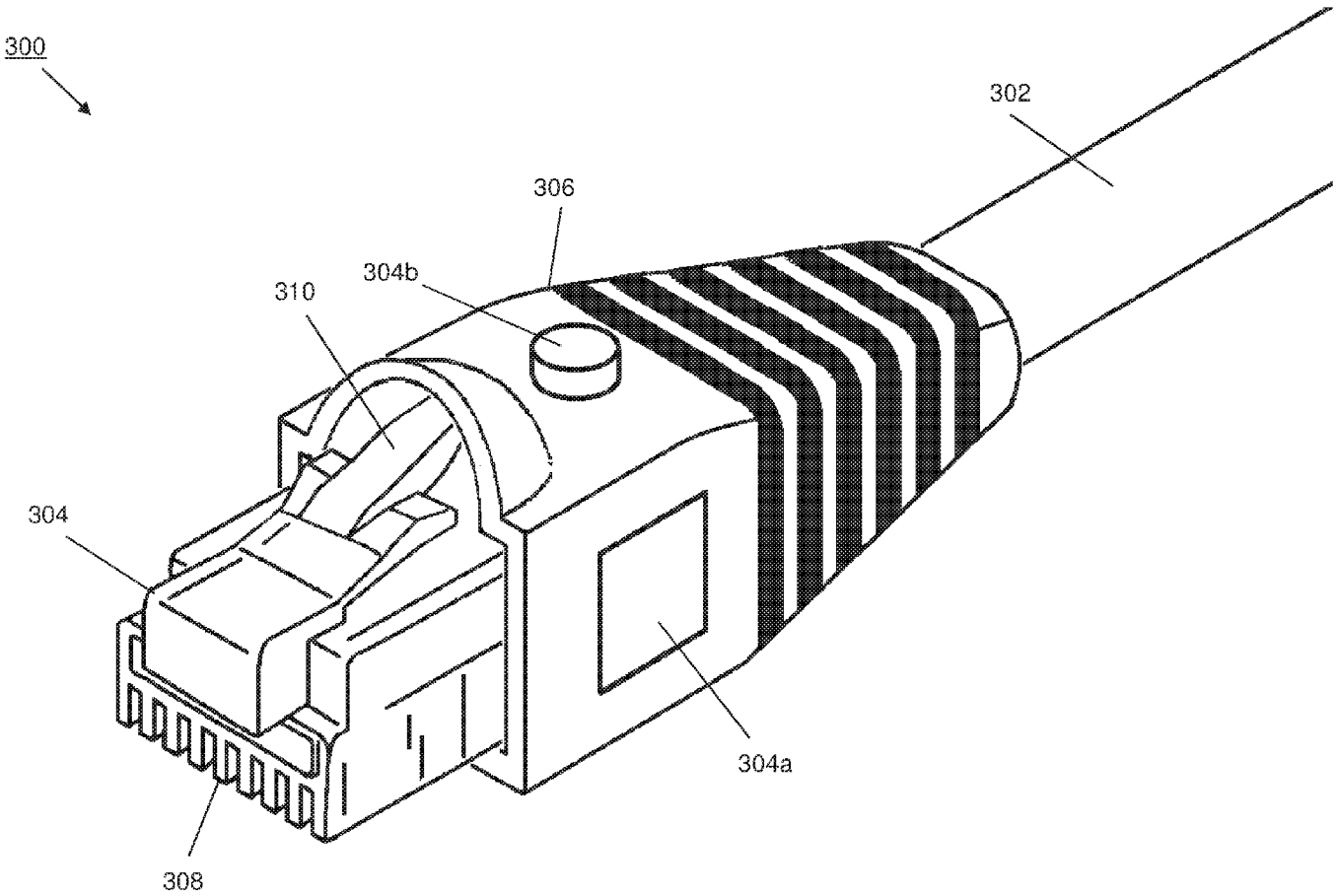
FIG. 3 is a perspective view illustrating an embodiment of a cable connector on the cable identification system of FIG. 2.

Referring now to FIG. 3, an embodiment of a portion of a cable identification system 300 is illustrated that may be a portion of the cable identification system 200 discussed above with reference to FIG. 2. The portion of the cable identification system 300 is provided to illustrate an embodiment of a connector end of the cable identification systems according to the teachings of the present disclosure, and thus may be provided for any connector end of a cable on a cable identification system that is provided according to the teachings of the present disclosure. As such, the cable identification system 300 includes a cable 302 that may be the cable 202 discussed above with reference to FIG. 2, and a connector 304 that may be either or both of the first connector 204 and the second connector 206 discussed above with reference to FIG. 2. The portion of the cable identification system 300 includes a connecter sheath 306 that extends from the cable 302 and over a portion of the connector 304. In the illustrated embodiment, a light emitting device 304*a*

(which may be the first light emitting device 204*a* on the first connector 204 and/or the second light emitting device 206*a* on the second connector 206, discussed above with reference to FIG. 2) extends from the connector 304 and is visible on a surface of the connector sheath 306, and an identification actuator 304*b* (which may be the first identification actuator 204*b* on the first connector 204 and/or the second identification actuator 206*b* on the second connector 206, discussed above with reference to FIG. 2) extends from the connector 304 and through the connector sheath 306. One of skill in the art in possession of the present disclosure will recognize that the connector 304 is illustrated as an Ethernet connector and, as such, includes a male connection end 308 defining eight slots that correspond to respective connection pads attached to wires provided by four twisted pairs of wiring that extend through the cable 302 (e.g., to provide the information transmission conduit 202 discussed above with reference to FIG. 2), and a female port securing feature 310 that is configured to secure the connector 308 in an Ethernet port, as well as be actuated to release the connector 308 from that Ethernet port. However, while a specific connector end of a cable identification system has been illustrated and described in FIG. 3, one of skill in the art will recognize that a variety of other types of connectors may be utilized in the cable identification systems of the present disclosure while remaining within its scope.

Figure 4A:
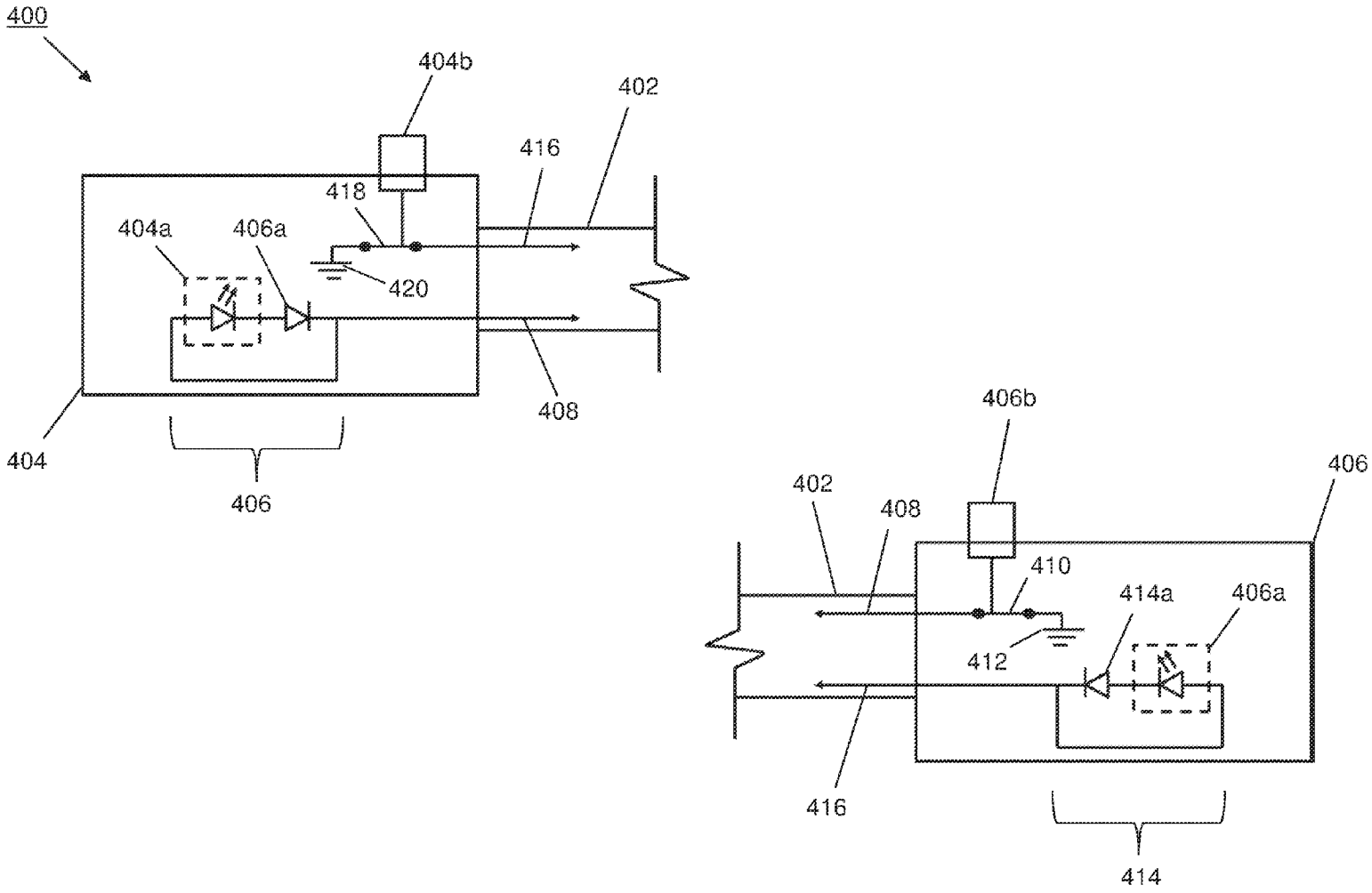
FIG. 4A is a schematic view illustrating an embodiment of the cable identification system of FIG. 2.
Figure 4B:
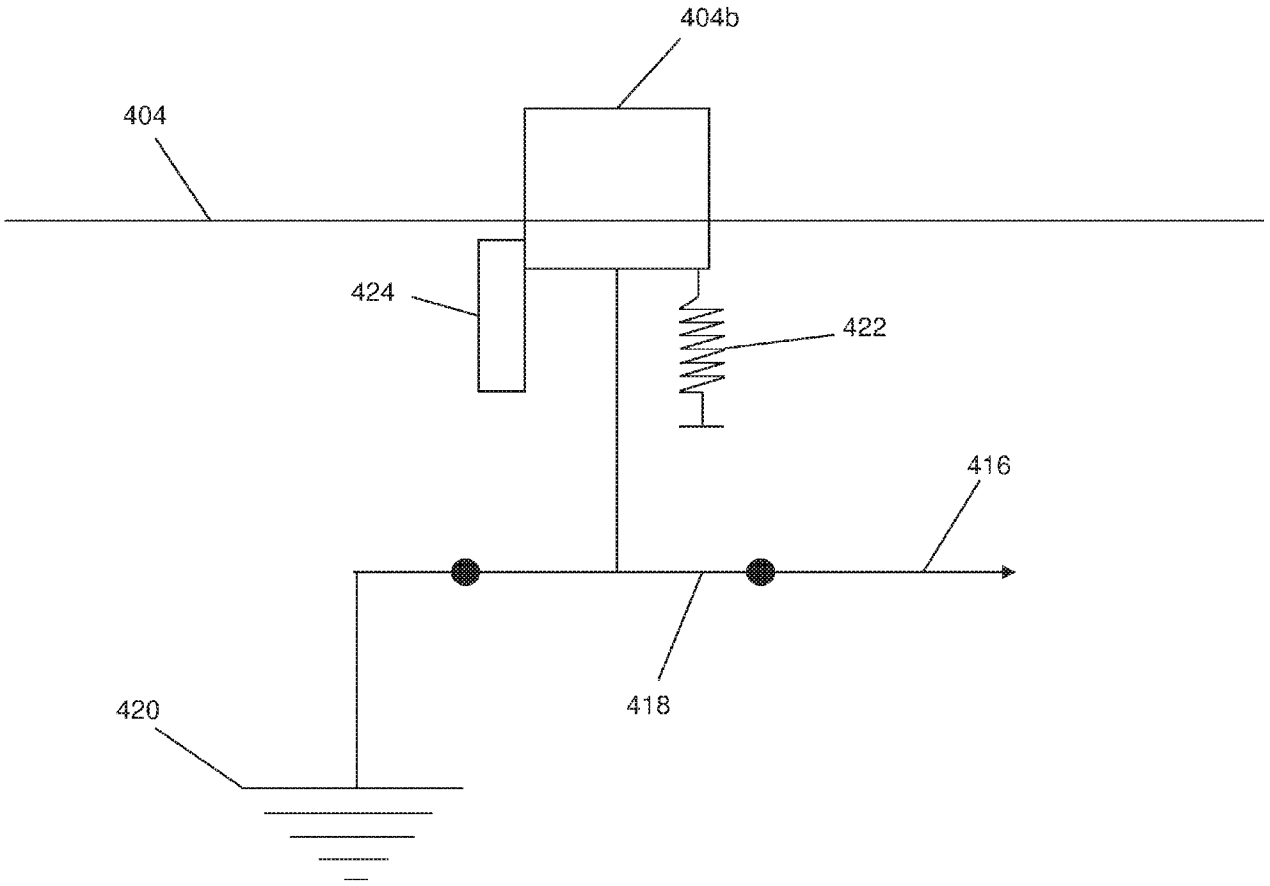
FIG. 4B is a schematic view illustrating an embodiment of an identification actuator biasing locking mechanism on the cable identification system of FIG. 2.

Referring now to FIGS. 4A and 4B, and embodiment of a cable identification system 400 is illustrated that may the cable identification system 200 discussed above with reference to FIG. 2. As such, the cable identification system 400 includes a cable 402 that may be the cable 202 discussed above with reference to FIG. 2, with the cable 402 extending between a first connector 404 that may be the first connector 202 discussed above with reference to FIG. 2, and a second connector 406 that may be the second connector 206 discussed above with reference to FIG. 2. Furthermore, the first connector 404 includes a first light emitting device 404*a* that may be the first light emitting device 204*a* discussed above with reference to FIG. 2*a*, and first identification actuator 404*b* that may be the first identification actuator 204*b* discussed above with reference to FIG. 2. Further still, the second connector 406 includes a second light emitting device 406*a* that may be the second light emitting device 206*a* discussed above with reference to FIG. 2, and a second identification actuator 406*b* that may be the second identification actuator 206*b* discussed above with reference to FIG. 2. As discussed above, while the first light emitting device 404*a* and the second light emitting device 406*a* are illustrated as being provided by Light Emitting Diodes (LEDs), other light emitting devices that are configured to provide the functionality below may be substituted for LEDs, and/or other identifiers/indicators may be utilized in appropriate embodiments, while remaining within the scope of the present disclosure.

In the illustrated embodiment, the first connector 404 includes a first loop circuit 406 having the first light emitting device 404*a* and a first diode 406*a*. The first loop circuit 406 is connected to a first wire 408 that extends through the cable 402. For example, the first wire 408 may extend through the cable 402 as part of the information transmission conduit 202*a* discussed above with reference to FIG. 2 (e.g., as part of twisted pair wiring provided in an Ethernet cable), or separately from the information transmission conduit 202*a*. In a specific example, the first wire 408 may be provided by a wire in a twisted pair of an Ethernet cable that is coupled to pin 4 or pin 5 on the Ethernet connectors. Furthermore, the first wire 408 extends through the cable 402 and is connected to a second switch 410 that is coupled to the second identification actuator 406*b* on the second connector 406 and configured to be connected and disconnected to ground 412 via actuation of the second identification actuator 406*b*, as discussed below. While the first loop circuit 406 is illustrated as entirely located in the first connector 404, in some embodiments, the first loop circuit 406 may be located in the cable 402, or may extend between the first connector 404 and the cable 402, while remaining with the scope of the present disclosure. As discussed below, the first loop circuit 406 may be sized such that it provides resonance in response to radio waves having predetermined characteristics.

In the illustrated embodiment, the second connector 406 includes a second loop circuit 414 that includes the second light emitting device 406*a* and a second diode 414*a*. The second loop circuit 414 is connected to a second wire 416 that extends through the cable 402. For example, the second wire 416 may extend through the cable 402 as part of the information transmission conduit 202*a* discussed above with reference to FIG. 2 (e.g., as part of twisted pair wiring provided in an Ethernet cable), or separately from the information transmission conduit 202*a*. In a specific example, the second wire 416 may be provided by a wire in a twisted pair of an Ethernet cable that is coupled to pin 4 or pin 5 on the Ethernet connectors (e.g., the wire connected the pins not being utilized by the first wire 408.) Furthermore, the second wire 416 extends through the cable 402 and is connected to a first switch 418 that is coupled to the first identification actuator 404*b* on the first connector 404 and configured to be connected and disconnected to ground 420 via actuation of the first identification actuator 404*b*, as discussed below. While the second loop circuit 414 is illustrated as entirely located in the second connector 406, in some embodiments, the second loop circuit 414 may be located in the cable 402, or may extend between the second connector 406 and the cable 402, while remaining with the scope of the present disclosure. As discussed below, the second loop circuit 414 may be sized such that it provides resonance in response to radio waves having predetermined characteristics.

In an embodiment, the first diode 406*a* and/or the second diode 414*a* may be provided by a germanium diode. For example, germanium diodes generally provide a voltage drop of approximately 0.3 volts, and in many of the embodiments discussed below may be utilized as the first diode and/or the second diode over silicon diodes that generally provide voltage drops of approximately 0.7 volts. As discussed below, the relatively low voltage drop of germanium diodes (as well as their relatively low point-contact capacitance) provides for benefits in the operation of the cable identification system 400 (e.g., their more effective operation at the relatively high radio frequencies used to provide the radio waves discussed below.) However, other types of diodes may provide the functionality discussed below, and those diodes will fall within the scope of the present disclosure as well. For example, silicon Schottky diodes (e.g., 1N60P and 1N60 diodes) generally provide a voltage drop of approximately 0.24 to 0.32 volts, and may be suitable to provide the functionality discussed below in some embodiments (e.g., when the radio waves produce sufficient current in the loop circuit to overcome the point-contact capacitance and voltage drop of the diode to light the light emitting device.) Thus, one of skill in the art in possession of the present disclosure will understand that the type of diode used in the loop circuits may be dependent on the details of the other components of the cable identification system.

Referring now to FIG. 4B, an embodiment of the first connector 404 is illustrated to provide an example of an identification actuator biasing/locking mechanism, and one of skill in the art will recognize that the identification actuator biasing/locking mechanism may be provided with the second connector 406 while remaining within the scope of the present disclosure. In the illustrated embodiment, a biasing element 422 is coupled to the first identification actuator 404*b* and operates to bias the first identification actuator 404*b* such that the coupling between the first identification actuator 404*b* and the switch 418 causes the switch 418 to couple the second wire 416 to ground 420 when the first identification actuator 404*b* is not actuated (e.g., when no force is applied to the first identification actuator 404*b*.) While the biasing element 422 is illustrated as a spring, one of skill in the art in possession of the present disclosure will recognize that other biasing elements and/or techniques will fall within the scope of the present disclosure as well.

In the illustrated embodiment, an actuator lock mechanism 424 is coupled to the first identification actuator 404*b* and operates to engage the first identification actuator 404*b* and hold the first identification actuator 404*b* in position following an actuation of the first identification actuator 404*b* that causes the switch 418 to decouple the second wire 416 from ground 420, discussed in further detail below. In a specific embodiment, the biasing element 422 and/or the actuator lock mechanism 424 may be provided with the first identification actuator 404*b* as part of a "push-push button" that operates via a first force that is applied to the first identification actuator 404*b* (and then removed) to decouple the second wire 416 from ground 420 via the switch 418, and keep the second wire 416 decoupled from ground 420 until a second force is then applied to the first identification actuator 404*b* to cause the switch 418 to recouple the second wire 416 to ground 420. However, one of skill in the art in possession of the present disclosure will recognize that other identification actuator biasing/locking mechanisms will fall within the scope of the present disclosure as well. Furthermore, as discussed below, in some embodiments the identification actuator biasing/locking mechanism may be omitted from the cable identification system of the present disclosure.

Figure 5:
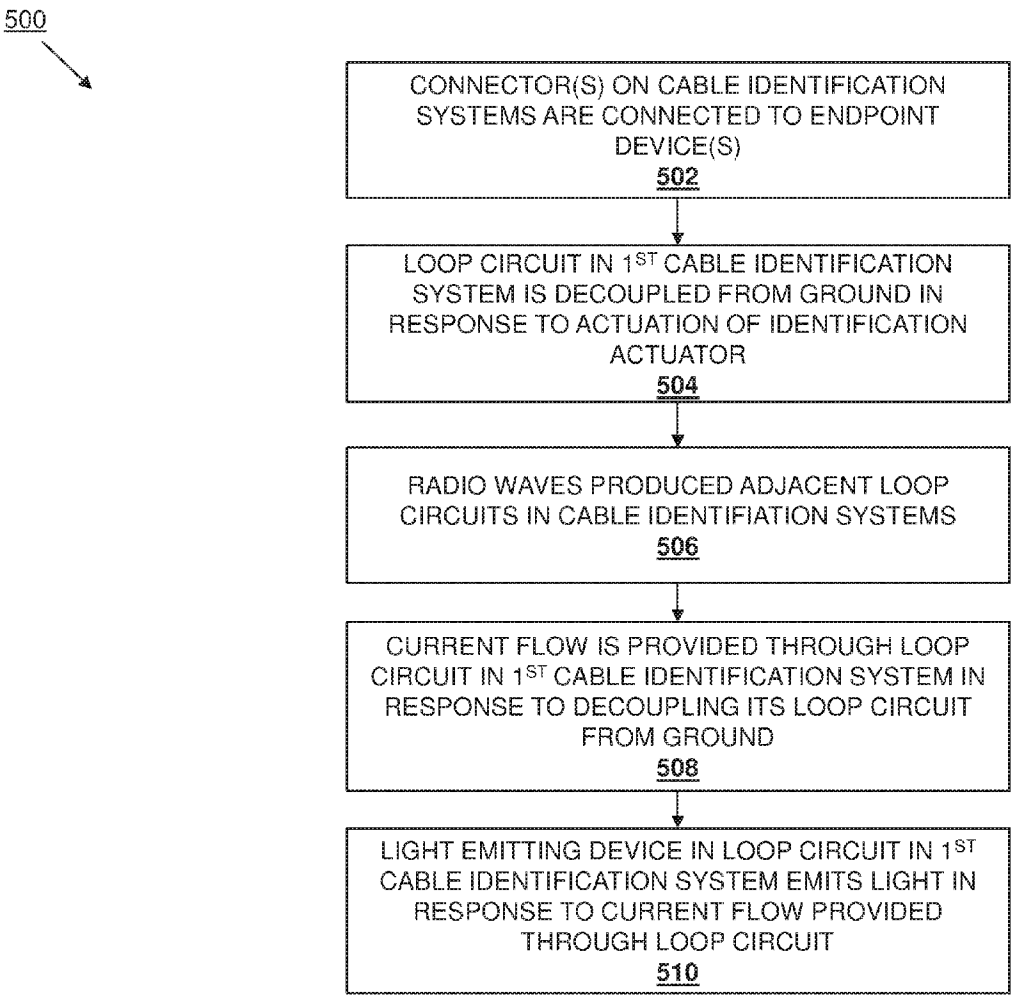
FIG. 5 is a flow chart illustrating an embodiment of a method for identifying a cable.

Referring now to FIG. 5, an embodiment of a method 500 for identifying a cable is illustrated. As discussed below, the systems and methods of the present disclosure provide for the identification of cables and/or the device connected to them without the need to provide power to the cables via a battery or device connected to the cables. Rather, the systems and methods of the present disclosure provide a loop circuit in each cable that includes a light emitting device and that is configured to be coupled to and decoupled from ground via a switch. When a cable of a plurality of cables is to be identified, an identification actuator on that cable may be actuated to disconnect its loop circuit from ground, and a wireless communication device may then be moved adjacent the plurality of cables while transmitting wireless signals to produce radio waves. As the radio waves are produced adjacent the loop circuit in each of the plurality of cables, a current flow will be induced in those loop circuit, but that current flow will discharge to ground when those loop circuits are coupled to ground via their switches. However, when the wireless communication device is moved adjacent the cable that has had its identification actuator actuated to disconnect its loop circuit from ground, the radio waves produced adjacent that loop circuit will induce a current flow in that loop circuit that will flow through the light emitting device (rather than be discharged to ground) and cause the light emitting device to emit light. As such, the actuation of the identification actuator on the cable and the production of radio waves by a wireless communication device adjacent a loop circuit in that cable operates to provide for the emission of light from that cable that allows for the identification of that cable without the need for battery power in the cable or power from a device connected to that cable.

Figure 6:
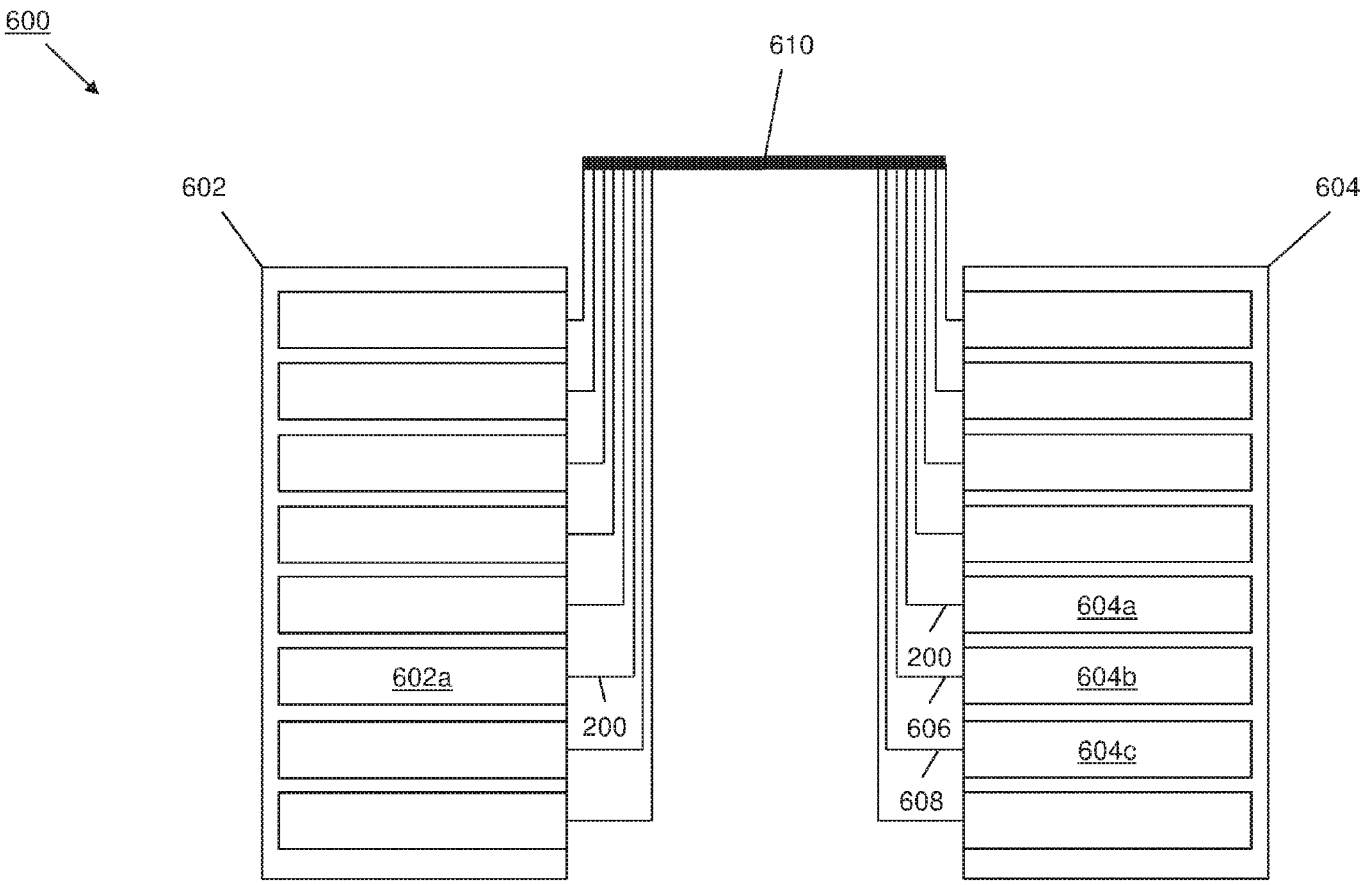
FIG. 6 is a schematic view illustrating an embodiment of an Information Handling System (IHS) including a plurality of devices connected together by cable identification systems such as the cable identification system of FIG. 2.
Figure 7:
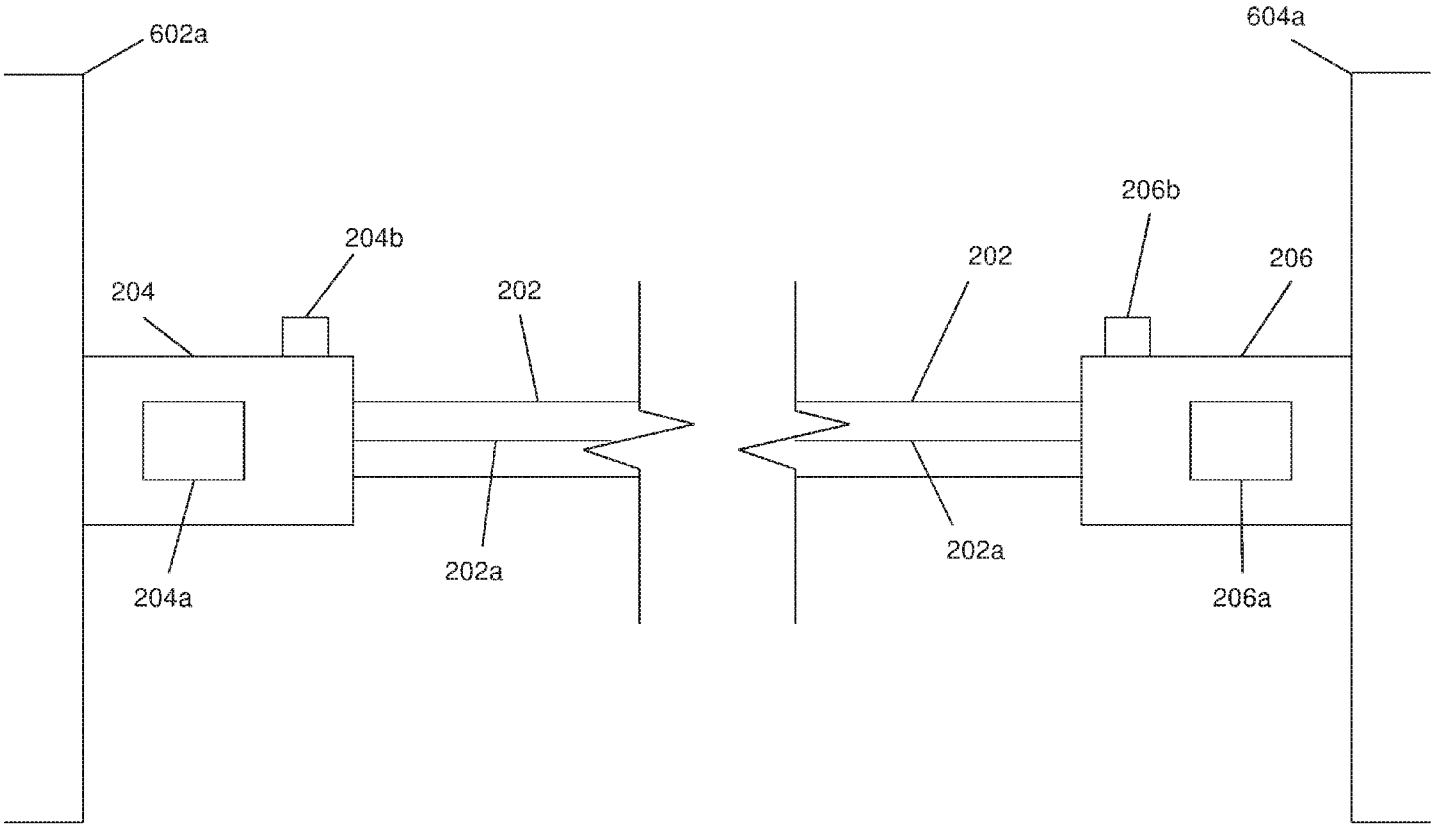
FIG. 7 is a side view illustrating an embodiment of a pair of devices connected together by the cable identification system of FIG. 2.

The method 500 begins at block 502 where connector(s) on cable identification systems are connected to endpoint device(s). Referring now to FIG. 6, an embodiment of an IHS 600 is illustrated that includes a plurality of device coupled together by the cable identification systems of the present disclosure. In the illustrated embodiment, the IHS 600 includes a rack/device chassis 602 housing a plurality of devices that include the device 602*a* that is identified for discussion below. For example, the devices in the rack/device chassis 602 may include servers, switches, storage systems, and/or other devices known in the art. In the illustrated embodiment, the IHS 600 also includes a rack/device chassis 604 housing a plurality of devices that include the devices 604*a*, 604*b*, and 604*c* that are identified for discussion below. For example, the devices in the rack/device chassis 604 may include servers, switches, storage systems, and/or other devices known in the art. In the illustrated embodiment, the device 602*a* is connected to the device 604*a* by the cable identification system 200 discussed above. With reference to FIG. 7, in an embodiment of block 502, the cable identification system 200 may be used to couple the device 602*a* to the device 604*a* by connecting the first connector 204 to a port (e.g., an Ethernet port) on the device 602*a*, routing the cable 202 through any cable routing subsystems on the rack/device chassis 602, routing the cable 202 through a conduit 610, routing the cable 202 through any cable routing subsystems on the rack/device chassis 604, and connecting the second connector 206 to a port (e.g., an Ethernet port) on the device 604*a*.

As illustrated in FIG. 6, the device 604*b* is coupled to another device in the IHS 600 by a cable identification system 606 that may be substantially similar to the cable identification system 200 discussed above, the device 604*c* is coupled to another device in the IHS 600 by a cable identification system 608 that may be substantially similar to the cable identification system 200 discussed above, and each of those devices 604*b* and 604*c* may be coupled to their respective other devices via the cable identification systems 606 and 608 in substantially the same manner as described above for the cable management system 200. Furthermore, one of skill in the art in possession of the present disclosure will recognize that the other devices in the racks/device chassis 602/604 (and other racks/device chassis) may be connected to other devices in the IHS via cabling (only some of which is illustrated in FIG. 6), and that cabling may be routed through conduits such as the conduit 610, making the identification, tacking, or tracing of any particular cable connected to any particular devices very difficult and time consuming without the use of the teachings of the present disclosure.

Figure 9A:
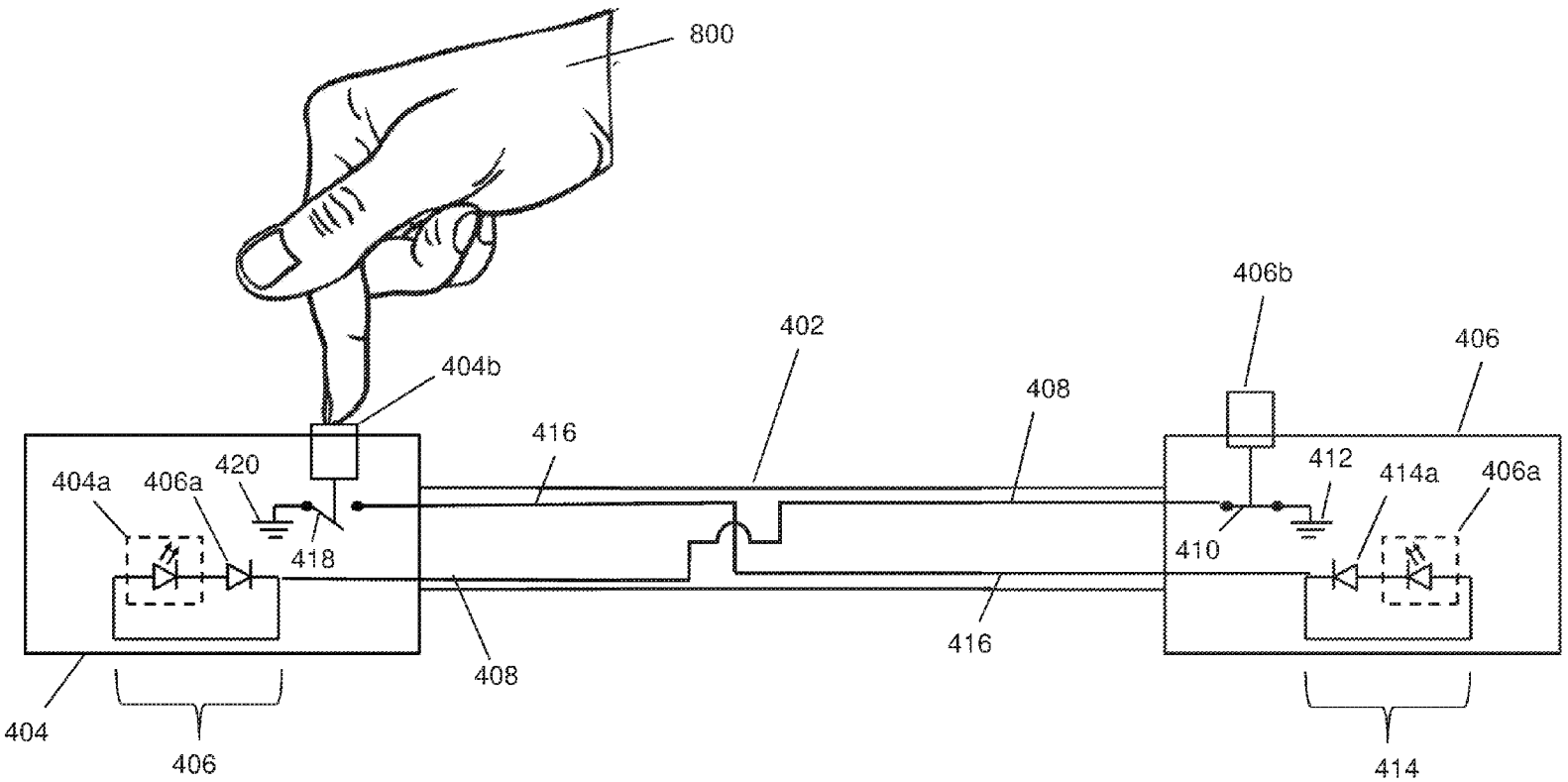
FIG. 9A is a schematic view illustrating an embodiment of the user providing for the identification of a cable and/or the device connected to that cable in FIG. 8.
Figure 9B:
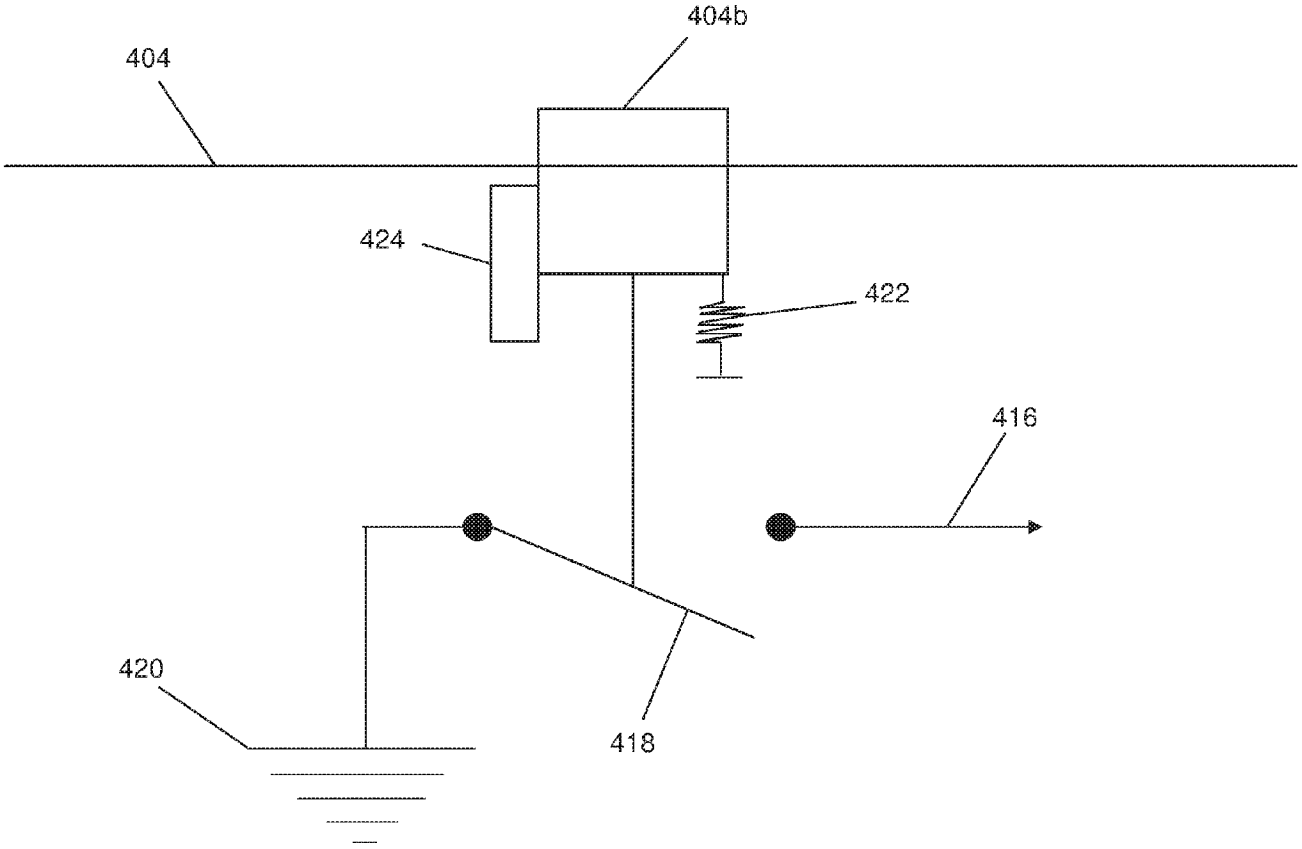
FIG. 9B is a schematic view illustrating an embodiment of the identification actuator biasing locking mechanism of FIG. 4B upon actuation of its identification actuator.

The method 500 then proceeds to block 504 where a loop circuit in a first cable identification system is decoupled from ground in response to the actuation of an identification actuator. In an embodiment, a user of the IHS 600 may wish to use the cable identification system 200 to determine which of the devices in the IHS 600 is connected to the device 602*a*. Referring now to FIGS. 8 and 9A, in such an embodiment, at block 504 a user 800 may actuate the first identification actuator 204*b* on the first connector 204 of the cable identification system 200 by applying a force (e.g., with their finger(s)) that moves the first identification actuator 204*b*/404*b* and, via the coupling of the first identification actuator 204*b*/404*b* to the first switch 418, causes the first switch 418 to decouple the second wire 416 from ground 420. Referring now to FIG. 9B, in an embodiment of block 504, the force applied by the user 800 on the first identification actuator 204*b*/404*b* may overcome a biasing force provided by the biasing element 422 to cause the first switch 418 to decouple the second wire 416 from ground 420. Furthermore, at some point during the actuation of the first identification actuator 204*b*/404*b*, the actuator lock mechanism 424 may engage the first identification actuator 204*b*/404*b* to "lock" or otherwise hold the first identification actuator 204*b*/404*b* in position (e.g., in the position illustrated in FIG. 9B) even once to the user 800 has stopped providing the force on the first identification actuator 204*b*/404*b* in order to keep the second wire 416 decoupled from ground 420 in response to one push-and-release of the first identification actuator 204*b*/404*b* by a user. However, as discussed above, in other embodiments the identification actuator biasing/locking mechanism may be omitted, and the user 800 may instead continuously apply the force on the first identification actuator 204*b*/404*b* in order to provide for the cable identification discussed below.

The method 500 then proceeds to block 506 where radio waves are produced adjacent loop circuits in the cable identification systems. In an embodiment, at block 506, a wireless communication device 1000 may be operated to transmit wireless communications such that the wireless communication device 1000 produces radio waves 1002, and the wireless communication device 1000 may then be moved adjacent the loop circuits (e.g., in the second connectors 206) in the cable identification systems 200, 606, 608, and any other cable identification systems that a user may believe is connected to the device 602*a*. In an embodiment, the transmission of wireless communications to produce radio waves may be produced by an application running on the wireless communication device 1000. For example, the application running on the wireless communication device 1000 may be an application that operates separately and distinctly from the cable identification system of the present disclosure. In a specific example, the application running on the wireless communication device 1000 may be a text messaging application that produces the wireless communications by sending a text message, an email application that produces the wireless communications by determining if any new messages have been received, and/or other applications that provide for the wireless communication of information to a base station, cellular tower, or other system that produces radio waves from the wireless communication device. As such, one of skill in the art in possession of the present disclosure will recognize that the wireless communications produced by the wireless communication device 1000 at block 506 may be a result of the application operating according to explicitly instructions from its user (e.g., the sending of a text message), or may be a result of background communications that are performed by the wireless communication device 1000 without explicit instruction from its user (e.g., "pinging" a base station or cellular tower in a background of an operating system running on the wireless communication device 1000.)

In another embodiment, the application running on the wireless communication device 1000 may be an application that is configured to operate with the cable identification system of the present disclosure to cause the wireless communication device 1000 to perform wireless communications to produce the radio waves 1002 (e.g., to send any type of data wirelessly for the purpose of producing the radio waves 1002.) As such, a user of the wireless communication device 1000 may launch the application in order to cause the production of the radio waves 1002, and then move the wireless communication device 1000 adjacent the cable identification systems as discussed above. In these different embodiments, the radio waves 1002 produced by the wireless communication device 1000 and/or the loop circuits in the cable management systems may be configured to maximize the current flow through any particular loop circuit when the radio waves 1002 are produced adjacent that loop circuit. For example, as discussed above, the loop circuits may be sized to provide resonance in response to radio waves having predetermined characteristics and, as such, the loop circuits may be sized based on radio waves known to be produced by the wireless communication device 1000 when operating separately and distinctly from the cable identification system, or when operating an application provided for the cable identification system to produce radio waves having desired characteristics. While the wireless communication device 1000 is illustrated as a mobile phone, one of skill in the art in possession of the present disclosure will recognize that a variety of other devices that produce radio waves may be provided in place of the mobile phone of the illustrated embodiments while remaining within the scope of the present disclosure.

Referring now to the embodiment illustrated in FIG. 10A, and with reference to FIG. 4A, at block 506 the wireless communication device 1000 may be operated to perform wireless communications to produce the radio waves 1002, and then be moved by the loop circuits in the cable identification systems 200, 606, 608, and other cable identification systems in the IHS 600 (e.g., in the direction A illustrated in FIG. 10A.) In the illustrated embodiment, each of the cable identification systems 606 and 608 may be substantially similar to the cable identification system 400 illustrated in FIG. 4A, with the respective first identification actuators 404*b* on their respective first connectors 404 not actuated such that the second wire 416 is coupled to ground 420 via the first switch 418. As such, when the radio waves 1002 are produced adjacent their respective second loop circuits 414 in their second connectors 406, any current flow induced in those second loop circuits 414 will be discharged through the second wire 416 and the first switch 418 to ground 420. As such, the radio waves 1002 produced adjacent the second loop circuits 414 in the cable identification systems 606 and 608 will not produce a current flow in the those second loop circuits 414 that is sufficient to cause the second light emitting devices 406*a* in those second loops circuits 414 to emit light.

The method 500 then proceeds to block 508 where current flow is provided through the loop circuit in the first cable identification system in response to the decoupling of its loop circuit from ground. With reference to FIGS. 9A, 10A, and 10B, the operation of the wireless communication device 1000 to perform wireless communications that produce the radio waves 1002, along with the movement of the wireless communication device 1000 in the direction A and adjacent the second connector 206, will cause the wireless communication device 1000 to produce the radio waves 1002 adjacent the second loop circuit 414 in the second connector 206 on the cable management system 200. In an embodiment, at block 508, the production of radio waves adjacent the second loop circuit 414 in the second connector

206/406 will induce a current flow in the second loop circuit 414, and due to the decoupling of the second wire 416 from ground 420 via the first switch 418 (in response to the actuation of the first identification actuator 404*b*), that induced current flow is provided through the second loop circuit 414 for as long as the radio waves 1002 are produced adjacent that second loop circuit 414.

The method 500 then proceeds to block 510 where a light emitting device in the loop circuit in the first cable identification system emits light in response to the current flow provided through the loop circuit. In an embodiment, at block 510, the provisioning of the current flow through the second loop circuit 414 in the second connector 206 causes that current flow to flow through the first diode 414*a* and the first light emitting device 406*a*. As illustrated in FIG. 10B, the provisioning of the current flow through the second light emitting device 406*a* causes the second light emitting device 406*a* to emit light 1004, thus providing an indication of the second connector 206 and/or second end of the cable 202 opposite the first connector 204, as well as the device 604*a* that is coupled to the device 602*a* via the cable identification system 200. As discussed above, while indications/identifications via light have been described, one of skill in the art in possession of the present disclosure will recognize that other indicators/identifiers (e.g., sound, movement, etc.) may be utilized with the loop circuit described above if the current flow provided in response to the radio waves is sufficient to power that indicator/identifier.

Thus, systems and methods have been described that provide for identification of a cable or a device connected to that cable without the need to internally power that cable (e.g., via a battery that may run out of power), or draw power from a device that may be subject to failure. Using the systems and methods of the present disclosure, a user may find a first portion of cable (e.g., a first connector which may or may not be connected to a device, a portion of the cable extending from the first connector, etc.), and then activate the cable identification system by decoupling a loop circuit in the cable from ground (e.g., via an identification actuator provided on that portion of the cable.) The user may then move a mobile phone that is producing radio waves adjacent a second portion of the cable that includes the loop circuit (e.g., a second connector which may or may not be connected to a device, a portion of the cable extending from the second connector, etc.) to induce a current flow in that loop circuit that will cause a light emitting device that is located somewhere on the cable to emit light, thus identifying the second portion of the cable that includes the first portion of the cable. The systems and methods of the present disclosure are envisioned as being particularly valuable in large datacenters where many cables are routed side-by-side, sometimes across relatively long distances, to connect devices, as connected devices can quickly and easily identified by the cable that connects them by simply activating the cable identification system at one end of the cable, and then moving a mobile phone adjacent other cables until a light emitting device on one of those cables emits light to provide the identification.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A cable identification system, comprising:

a cable;

a first connector that is located on the cable and that includes a first light emitting device;

a first loop circuit that includes the first light emitting device and a first diode, wherein the first loop circuit is connected to a first wire that extends through the cable; and a second connector that is located on the cable and that includes a second identification actuator that is configured to decouple the first wire from ground such that first radio waves produced adjacent the first loop circuit will induce a first current flow in the first loop circuit that causes the first light emitting device to emit light.

2. The system of claim 1, further comprising:

a second light emitting device included on the second connector;

a second loop circuit that includes the second light emitting device and a second diode, wherein the second loop circuit is connected to a second wire that extends through the cable; and a first identification actuator that is included on the first connector and that is configured to decouple the second wire from ground such that second radio waves produced adjacent the second loop circuit will induce a second current flow in second loop circuit that causes the second light emitting device to emit light.

3. The system of claim 1, wherein the second identification actuator is biased such that the first wire is coupled to ground when the second identification actuator is not actuated, and wherein the system further comprises:

an actuator lock mechanism that is configured, when the second identification actuator has been actuated to decouple the first wire from ground, to engage the second identification actuator such that the second identification actuator remains actuated to decouple the first wire from ground.

4. The system of claim 1, wherein the first diode is a germanium diode.

5. The system of claim 1, wherein the first radio waves are produced by a mobile computing device transmitting wireless communications.

6. The system of claim 5, wherein the mobile phone includes an application that is run to cause the transmission of the wireless communications that produce the first radio waves.

7. The system of claim 1, wherein the first loop circuit is sized to provide a resonance that allows the first current flow produced by the first radio waves in first loop circuit to cause the first light emitting device to emit light.

8. An Information Handling System (IHS), comprising a first device;

a second device;

a cable extending between the first device and the second device;

a first connector that is located on the cable and connected to the first device;

a first light emitting device that is included on the first connector;

a first loop circuit that includes the first light emitting device and a first diode, wherein the first loop circuit is connected to a first wire that extends through the cable;

a second connector that is located on the cable and connected to the second device; and a second identification actuator that is located on the second connector and that is configured to decouple the first wire from ground such that first radio waves produced adjacent the first loop circuit will induce a first current flow in the first loop circuit that causes the first light emitting device to emit light.

9. The IHS of claim 8, further comprising:

a second light emitting device that is included on the second connector;

a second loop circuit that includes the second light emitting device and a second diode, wherein the second loop circuit is connected to a second wire that extends through the cable; and a first identification actuator that is located on the first connector and that is configured to decouple the second wire from ground such that second radio waves produced adjacent the second loop circuit will induce a second current flow in the second loop circuit that causes the second light emitting device to emit light.

10. The IHS of claim 8, wherein the second identification actuator is biased such that the first wire is coupled to ground when the second identification actuator is not actuated, and wherein the IHS further comprises:

an actuator lock mechanism that is configured, when the second identification actuator has been actuated to decouple the first wire from ground, to engage the second identification actuator such that the second identification actuator remains actuated to decouple the first wire from ground.

11. The IHS of claim 8, wherein the first diode is a germanium diode.

12. The IHS of claim 8, wherein the first radio waves are produced by a mobile computing device transmitting wireless communications.

13. The IHS of claim 8, wherein the first loop circuit is sized to provide a resonance that allows the first current flow produced by the first radio waves in first loop circuit to cause the first light emitting device to emit light.

14. A method for identifying a cable, comprising:

decoupling, in response to an actuation of a second identification actuator on a second connector that is located on the cable including a first connector having a first light emitting device, a first wire that extends through the cable from ground;

inducing, in response to a production of first radio waves adjacent a first loop circuit that is connected to the first wire and that includes a first diode and the first light emitting device, a first current flow through the first loop circuit;

providing, in response to the decoupling of the first wire from ground, the first current flow through the first loop circuit; and emitting, by the first light emitting device in response to the first current flow, light.

15. The method of claim 14, further comprising:

decoupling, in response to the actuation of a first identification actuator on the first connector that is located on the cable including the second connector having a second light emitting device, a second wire that extends through the cable from ground;

inducing, in response to a production of second radio waves adjacent a second loop circuit that is connected to the second wire and that includes a second diode and the second light emitting device, a second current flow through the second loop circuit;

providing, in response to the decoupling of the second wire from ground, the second current flow through the second loop circuit; and emitting, by the second light emitting device in response to the second first current flow, light.

16. The method of claim 14, biasing the second identification actuator such that the first wire is coupled to ground when the second identification actuator is not actuated; and engaging, when the second identification actuator has been actuated to decouple the first wire from ground, an actuator lock mechanism with the second identification actuator such that the second identification actuator remains actuated to decouple the first wire from ground.

17. The method of claim 14, wherein the first diode is a germanium diode.

18. The method of claim 14, wherein the first radio waves are produced by a mobile computing device transmitting wireless communications.

19. The method of claim 18, wherein the mobile phone includes an application that is run to cause the transmission of the wireless communications that produce the first radio waves.

20. The method of claim 14, wherein the first loop circuit is sized to provide a resonance that allows the first current flow produced by the first radio waves in the first loop circuit to cause the first light emitting device to emit light.

* * * * *